US008590238B1

(12) United States Patent
Polak

(10) Patent No.: US 8,590,238 B1
(45) Date of Patent: Nov. 26, 2013

(54) ARTIFICIAL BRICK FINISH FOR WALLS

(76) Inventor: Thomas L. Polak, Hellertown, PA (US)

( * ) Notice: Subject to any disclaimer, the term of this patent is extended or adjusted under 35 U.S.C. 154(b) by 0 days.

(21) Appl. No.: 13/341,712

(22) Filed: Dec. 30, 2011

Related U.S. Application Data

(63) Continuation-in-part of application No. 13/032,201, filed on Feb. 22, 2011, now abandoned.

(60) Provisional application No. 61/306,809, filed on Feb. 22, 2010.

(51) Int. Cl.
*B44F 9/04* (2006.01)

(52) U.S. Cl.
USPC ..... 52/314; 52/311.1; 52/315; 52/741.41

(58) Field of Classification Search
USPC ..... 52/314, 315, 316, 344, 348, 388, 389, 52/443, 449, 454, 745.09, 741.41
See application file for complete search history.

(56) References Cited

U.S. PATENT DOCUMENTS

| | | | | | |
|---|---|---|---|---|---|
| 1,799,750 | A * | 4/1931 | Hummert | 52/454 |
| 2,151,220 | A * | 3/1939 | Mattes | 428/146 |
| 2,162,861 | A * | 6/1939 | Polak | 52/314 |
| 2,602,232 | A * | 7/1952 | Keast | 33/454 |
| 2,616,145 | A * | 11/1952 | Dufford | 249/15 |
| 2,643,539 | A * | 6/1953 | Bouch | 52/302.3 |
| 2,748,443 | A * | 6/1956 | Dufford | 264/33 |
| 7,735,277 | B1 * | 6/2010 | Everhart et al. | 52/314 |
| 2011/0023396 | A1 * | 2/2011 | Schwarz et al. | 52/314 |

* cited by examiner

*Primary Examiner* — James Buckle, Jr.
(74) *Attorney, Agent, or Firm* — Charles A. Wilkinson; Clinton H. Wilkinson

(57) ABSTRACT

A simulative brick or other block covering for a wall is provided with grooves cut sufficiently deep into the coating to substantially separate all simulated structured sections from each other with respect to drying and coating on the outside with a waterproof acrylic coloring material.

13 Claims, 3 Drawing Sheets

ARTIFICIAL BRICK FINISH FOR WALLS

CROSS-REFERENCE TO PREVIOUS RELATED APPLICATION

This application is a continuation-in-part of U.S. application Ser. No. 13/032,201 filed on Feb. 22, 2011, which claims priority from U.S. provisional application Ser. No. 61/306,809, filed on Feb. 22, 2010, the disclosures of which are hereby incorporated herein by reference in their entireties.

BACKGROUND OF THE INVENTION

1. Field of the Invention

The present invention relates to the provision of coverings or facings for walls and the exterior surfaces of buildings that simulate or give the appearance that the wall or surface is constructed of another type of material, such as brick or stone. More particularly, the present invention relates to a system and method of providing an artificial facing upon a building wall which provides an impression of being constructed of materials such as bricks laid one upon another or in a variation of a natural stone or rock wall even though the wall itself may be formed of a less substantial construction such as a wooden construction or the like.

2. Preliminary Discussion and Description of Related Art

Wall panels and coverings that are simulative of or resemble materials such as brick, masonry or stone, as well as numerous processes for making the same, are known. In particular, there has been a need for a wall facing and process for constructing a wall facing that simulates as realistically as possible a natural brick or stone wall construction, that is durable and not subject to cracking or fissures, and in addition that requires a lesser number of skilled laborers working in a coordinated manner but rather can be completed in sections rather than requiring substantial completion of an entire wall surface area at one time.

U.S. Pat. No. 2,162,861 issued to L. Polak on Jun. 30, 1939 and as illustrated in FIGS. 1 and 2 teaches a method of providing an artificial wall covering involving the application of a sheet of waterproof material (6) to a wall, followed by attachment of a metal lath or mesh netting (9) or other reinforcing to the wall on top of the waterproof material. Next, several layers or coatings of an unset cement or plaster material are applied over the wire lath. The first layer or coating (10) is a "scratch coat" the preferred composition of which is disclosed as being a thick coating of lime plaster that is forced through the wire lath or mesh, completely enclosing it and filling the spaces between the lath and waterproof sheet. A composition of one part cement, two parts of lime, and three parts of sand is suggested. The sand need not be limited to fine grade, because the first layer is not part of the final coating exposed to the weather. The lime, however, provides extra adherence. After the first layer has substantially set, a second preferably thinner coating (11) of colored plaster called the "mortar joint coat" is applied to the face of the first coat. The color is appropriate to whatever the coating is to appear to be, for example, red if the wall is to appear as a brick wall, but any other color is appropriate. In general, the second layer is of finer materials than the first layer, and is damp proof to protect the first coat from moisture. Finally, when the second layer is set, a third layer (13) called the "finish color coat" in the form of a finer and even thinner plaster material preferably having a contrasting color from the second coat is applied to the face of the second coat. After the third layer of plaster has set slightly, and before the second coat has completely set, a straightedge or other suitable tooling such as a U-shaped blade is used to form grooves (13) in the finish by removing portions of the plaster entirely through the third coat of plaster plus partly into the second coat of plaster. The grooves are for the purpose of simulating brickwork, tiles or other surface materials (14) by creating the simulated appearance of mortar joints between the simulated bricks, tile or other desired simulative appearance. Additional colors can be added on top of the "finish color coat" to create a more realistic look or appearance.

This previous process of simulation has proved to be very successful and has been used with good results for many years, being applied largely under the trademark Brickote™. However, the Brickote™ process does have certain disadvantages. For instance, because of the necessity to apply all the layers while the cement and plaster are somewhat set, but only partially set, and because it is difficult to match adjacent areas, it is also necessary to assemble large amounts of materials sufficient to finish a job as a unit. The process, therefore, requires a large fast-working, well coordinated crew of workers, a requirement which is not always easy to fulfill under modern conditions, particularly as the Brickote™ simulated siding process is often applied by local contractors who may find it difficult to assemble an experienced crew on fairly short notice.

The present inventor realizing the drawbacks of the former method of applying the Brickote™ process has unexpectedly discovered that an alternative process can be used which is adaptable to discontinuous application and can be applied to large surfaces, one section at a time in basically a start and stop mode of application. A particular difficulty with stopping a conventional Brickote™ coating application operation is that if a partially completed surface dries out, too much cracking is liable to occur and any attempt to repair such cracks leaves a clearly evident defect which is almost impossible to disguise and which is also liable to increase in severity over time.

The present invention solves the previous difficulties in a clear and innovative way by providing in a preferred embodiment two cement layers upon a single wire reinforcement, such as galvanized wire lath, but instead of adding color to the individual plaster or cement layers on top of the scratch coat as in the just-described arrangement so that when the cement or plaster is cut down to form the outline of the bricks or blocks, the contrasting color of the underlying layers becomes evident, no coloring is added to the layers. In the present inventor's process, after the first coating has partially set up, a second or outer layer of plaster is applied to the face of the first coating. Then, when the second layer has partially set up, divisions or grooves are cut to form the simulated blocks, bricks, tile or the like. Such divisions or grooves are cut down near to the bottom of the two layers so that individual masses of plaster are defined, which individual masses set up and start drying separately from each other, and because of their lesser mass, have little tendency to crack and spall such as would or will occur if the prior Brickote™ process was used and interrupted.

In the present invention after the individual "bricks", "tiles", or "blocks" have set up, which under normal conditions typically takes a day or two, after which an outer coat comprised of an acrylic finish can then be applied to protect the whole surface. The colors of the blocks, tile, or bricks are thus provided by means of the outer coat or coating of acrylic pigment or paint carefully matched to the colors described, although a colored cement coat followed by a clear acrylic coat could also be provided. Meanwhile, the divisions or grooves between the simulated blocks, tiles, or bricks are left without an outer acrylic coating and serve as restrictive drying zones from which moisture can evaporate evenly to the atmosphere. The size of each of the simulated bricks, blocks or tiles is small enough in surface area so that these accumulations or masses of materials do not dry out significantly at differential speeds and spalling and cracking is thereby inhibited. The key to the process therefore is to divide a surface into a number of individual restricted area surfaces which are not large enough to develop significant transverse differential drying from the side which is liable to crack the surface and cause spalling and cracking of the coating. While the acceptable size of such individual units varies with actual conditions, it has been found that units which replicate conventional brick, stone, block, and tile wall covering are all within the acceptable range under the range of normal conditions. The vapor resistant acrylic coating once applied prevents large scale drying from the surface once it is itself dried, and the size of the uncoated surfaces between the simulated bricks, blocks or tiles are not large enough to allow the coated areas to significantly dry differentially and transversely to cause significant differential drying tensions. The acrylic coating layer is compatible with the underlying cement material because it is water-based and tends to dry along with the underlying cementitious material. Additional masonry acrylic coatings may be applied over the first coating to change the color, or to add texture and the like to the finished surface. Once this has dried, a conventional mortar is applied in the divisions or grooves serving as simulative mortar joints, and thus forming a finished simulated wall covering. The mortar may be colored or shaded as needed to match the coloring of the finished wall surface.

Because the simulated block, bricks or tiles are maintained in a size which is significantly restricted to prevent sufficient differential drying across a surface and to encourage drying of such material at a rate such as not to encourage cracking or spalling, the individual blocks do not spall or crack. The application of a moisture-proof coating on the surface furthermore prevents contained moisture from escaping vertically through the surface, thereby forcing moisture to escape through the uncoated simulated mortar in the joints between the units such that the drying rate is held within limits necessary to prevent spalling and cracking. This means that the drying rate is held to a minimum at any point dependent upon the space between the bricks, blocks or tiles. In other words, if the size of a unit surface feature is held to a size small enough to allow significant drying to occur only between blocks, bricks or tiles, cracking is found not to occur. This allows small sections of a whole wall surface to be applied even on alternate days or other time units because the entire surface is applied in individual surface units.

OBJECTS OF THE INVENTION

It is an object of the present invention, therefore, to provide an artificial brick or other block or stone type coating for a wall which can be applied in progressive sections without major cracking or spalling and in which the outer surface of the wall coating is protected by a color bonding layer.

It is a further object of the invention to provide an artificial brick or other simulative wall coating by a process which avoids so-called conventional joints while having the appearance of such joints.

It is a still further object of the invention to provide an artificial simulative wall covering having only two layers of plaster or cement, that does not require a scratch coat, and in which the coloring is provided by an outer layer of pigment.

It is a still further object of the invention to provide an artificial simulative wall coating which can be applied in small sections by one or two workers over an extended period as contrasted to applications by a gang of workers overall in a restricted period adapted to prevent cracks and defects in the coating.

It is a still further object of the invention to provide an artificial coating of the Brickote™ type which is subject to less shrinkage and cracking by way of providing an early separation of individual block and brick shapes, masses or the like before drying and setting up has progressed to the point where cracking by massive drying or "setting up" has a chance to occur.

It is a still further object of the invention to provide a convenient and economical method of providing an artificial wall covering simulative of a wall made of brick, blocks, or large tiles Other objects and advantages of the invention will become evident from review of the following description and appended drawings.

SUMMARY OF THE INVENTION

The present invention provides a simulated wall covering having the appearance of a stone, block, brick or tile surface, in which a series of restricted length grooves simulative of mortar joints are provided in larger surface accumulations of cementitious material, which grooves separate said larger surface accumulations into a plurality of smaller individual surface accumulations or units each having a surface area below the spall initiation limit of the material in a drying environment. This is accomplished by providing a maximum division between the individual cementitious surface accumulations or units by such grooves, combined with effective seating or sealing of the top surface by a sealing compound. In forming the simulative surface on a support wall, a weather barrier is preferably first applied to the wall surface, which is then covered by a galvanized wire lath secured to the wall. A first cement plaster coating is then applied over the lath, and once the first coating has substantially set, a second coating is applied on the face of the first coat. The total thickness of the two coats is preferably between $5/8^{th}$ inches and ¾ inches. After the second coating has substantially but not completely set, guide marks are placed on the outer surface of the wall coating, and then grooves are cut into the plaster entirely through the second coating, and through the first coating substantially down to or into close proximity with the wire lath. The coatings are then allowed to dry, leaving a plurality of essentially individual simulative tiles, bricks or stones separated by the deep grooves and each secured to the wire lath, which individual units are left to dry separately. Provision of such individual units retards stress and the formation of hairline cracks or spalls in the material. An exterior masonry acrylic coating having a preferred coloring is then applied on the outer faces of the individual units, but not in the grooves. If desired, second or third acrylic coatings are applied over the first acrylic coating to age or otherwise alter the appearance and coloring of the surface, or to add texture to the surface. Then, a conventional mortar or grout which may be colored to match the acrylic coating color if desired is applied in the grooves, forming simulative mortar joints. A primary advantage of the present system is that by cutting deep grooves at least substantially down to the wire lath, individual shrinkage of the cut units or sections is therefore allowed, and in addition internal moisture is able to escape through the grouted joints. Thus, an entire wall coating or covering, or at least a complete section, does not have to be finished in essentially one working period. The acrylic waterproof top coat also both protects the ceramic or cement wall covering surface, and allows the surface to be colored to simulate various ceramic materials such as brick and other ceramics and block.

DESCRIPTION OF THE PREFERRED EMBODIMENTS

Figure 1:
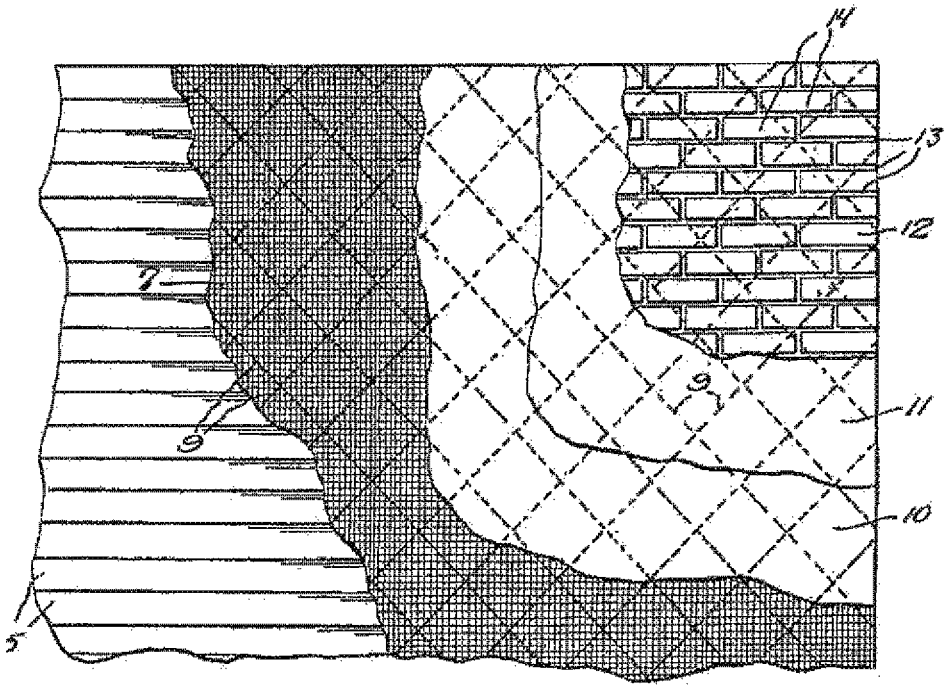
FIG. 1 (PRIOR ART)
FIG. 1 is a fragmentary elevational view illustrating the application of a previously patented artificial wall coating, commonly referred to as Brickote™
Figure 2:
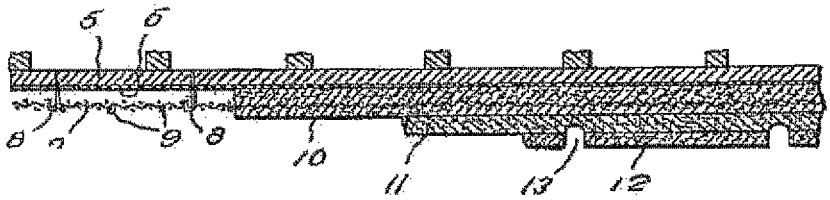
FIG. 2 (PRIOR ART)
FIG. 2 is an enlarged fragmentary horizontal sectional view of the prior art coating shown in FIG. 1.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

The present invention is as indicated above an improvement of a known coating process patented near the beginning of the Second World War, which has been quite successful and is still in substantial use, but has certain drawbacks in application since it cannot be applied in discontinuous operations because discontinuous setting and drying causes undesirable cracking and spalling.

The present invention eliminates such cracking and spalling by the provision of deeper grooves between the artificial cementitious forms which simulate brick, tile, stone, and/or blocks in the surface material plus the use, instead of differently colored layers of the cementation lime composition, which forms the simulated brick, or other layers, but instead provides an overall or outside coating having an acrylic composition in the form usually of acrylic paint, which because it is water-based is compatible with the water containing cementitious overall coating.

The acrylic finish over the surface dries more quickly than the underlying cementitious material and once it has set, provides a weatherproof surface that seals the underlying cementitious material from the weather, and at the same time is appropriately colored to represent the simulation of the underlying material which is to be effected. Once such coating has dried, it also seals the underlying materials from the weather and provides at its edges, an opening to the underlying cementitious material for continued drying or setting up of such material in individual blocks or accumulations or deposits that have a size which readily allows drying around the edges or from the edges and have overall sizes that are below a crack initiation size due to differential drying or setting up. Since the size of the deposits of material prevent cracking and spalling, it is possible, unlike the case with the Brickote™ process, to stop and start the application process, thus enabling the use of a much smaller crew of workers, as small as a single worker. In addition, possible weather damage such as by rain is ameliorated, which can be a significant issue if rain falls while a wall made using the Brickote™ process was being plastered or cut. This is because the entire wall does not need to be completed in one application, so work can be stopped until the weather clears, without worrying about "cold joints" or obvious stop and start points from appearing on the wall. The separations between cementitious form are preferably not painted with acrylic coloring material, but rather the separations are filled with a deposit of cementitious or mortar material. Placement of lime or mortar which is only lightly consolidated in the joints or separations between the individualized simulative tile, brick or stone units also allows evaporation of moisture from the sides of the units. Thus, the process of the improved invention not only allows continuous drying through the grooves, but provides an easy sealing of the top surfaces of the simulative individualized units. Sealing of the tops of the simulated building blocks or bricks allows slow uniform drying through the cut down sides of the forms. Since each simulated brick, block or tile form created is therefore relatively uniform in size and treatment, drying and setting of the composition is very uniform and essentially only very minute spalling or cracking of the simulated cementitious coating is encountered, as opposed to the shrinkage of a large area of an entire one piece wall where cracking is more prevalent. While the resulting Brickote™ coatings have proved very durable if carefully made, it is necessary to apply essentially an entire coating in a single operation at a relatively high rate of application so that the entire coating will be drying at once for satisfactory results. Otherwise, differential drying occurs and serious cracks and spalling are likely to occur, which defects are very difficult, if not impossible to correct.

The present inventor has now developed a new and improved wall coating system and method which in its most preferred embodiment only requires two coats of cementitious or plaster material be applied over a metal lath, both such layers being the same color. Thereafter, grooves representing the separations between the simulated brick, stone, blocks or tiles are cut down through the two layers to or almost to the metal lath. This operation essentially isolates each brick, block or tile simulation from every other so that each dries or sets individually or by itself, causing, if such bricks, blocks, or tiles are normal sized, a minimum of differential drying and shrinkage. Furthermore, a layer of acrylic paint such as red brick tinted paint is thereafter applied to the top surfaces of the individual simulated components such as the brick surfaces. This acrylic water based material is compatible with the wet cementitious material but quickly dries and provides a surface shield so that further drying and loss of moisture during hardening occurs essentially exclusively between the separate units along the edges thereof and because of the relatively small size of the individual sections differential drying and setting up is decreased or essentially eliminated and cracking and surface spalling is also eliminated.

Figure 3:
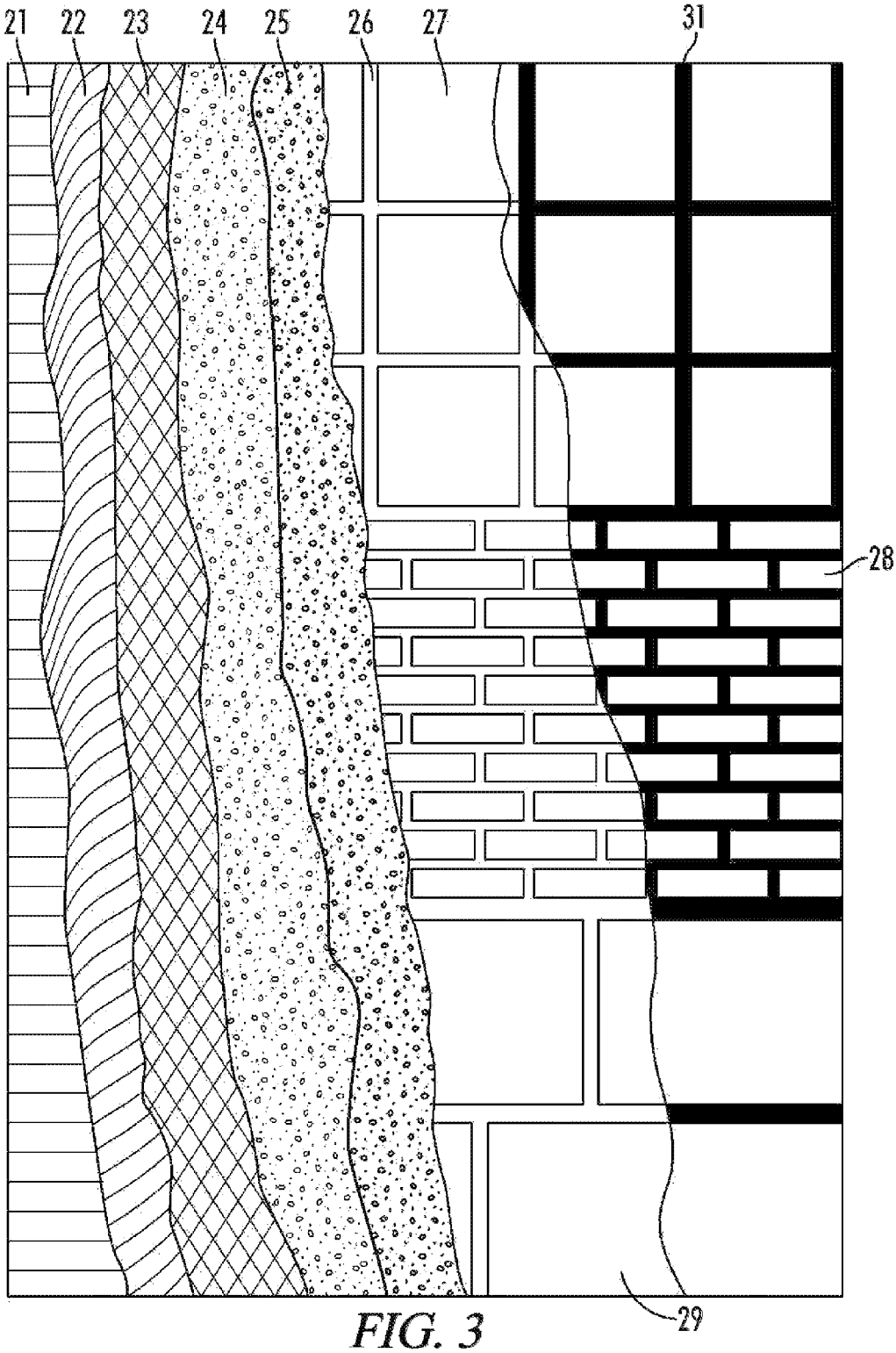
FIG. 3 is a fragmentary elevational view illustrating the application of the wall finish or coating to the wall of a frame building, in accordance with the present invention.
Figure 4:
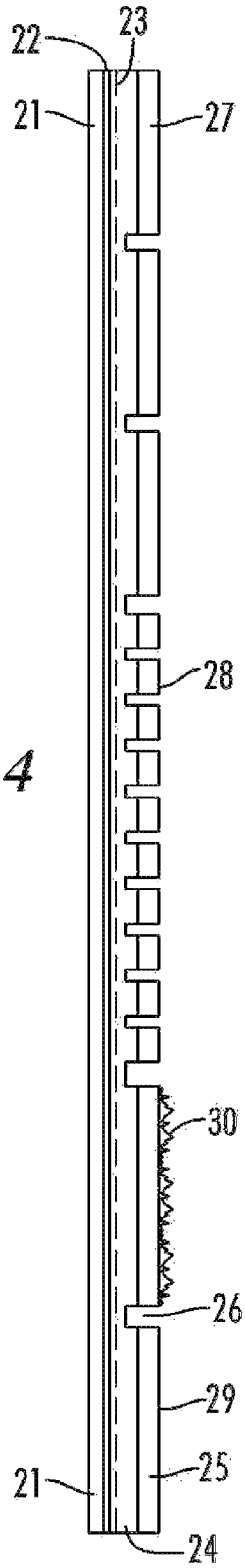
FIG. 4 is an enlarged fragmentary horizontal sectional view of the wall finish or coating shown in FIG. 1.
Figure 5:
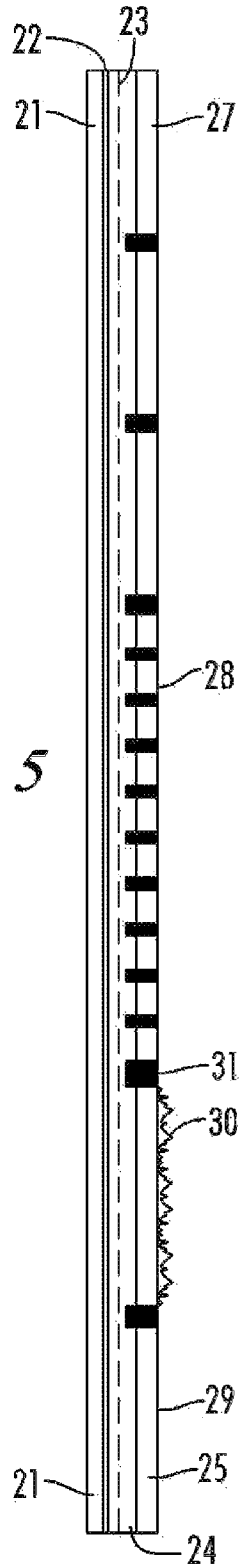
FIG. 5 is an enlarged fragmentary horizontal sectional view of the wall finish or coating as in FIG. 4 with mortar applied in the joints between the individualized wall units.

Referring now to FIGS. 3, 4, and 5, which illustrate a preferred embodiment of the present invention, there is shown existing siding or substrate 21 on the exterior surface of a building or a wall on which the simulated coating of the present invention is to be applied. First, a weather barrier 22 is secured over the face of substrate 21. Barrier 22 may be of different types and may vary according to the climate but preferably provides water resistance from the outside while being somewhat permeable to release water vapor from the inner side of the wall or wall cavity. Over this is applied a plaster base and reinforcing material such as wire lath or mesh 23 which conventionally is made of galvanized steel, but may made of other materials such as a plastic lath, and may also have different thicknesses or rigidities as well as further reinforcing ribs or the like depending upon the requirements of the particular application.

A cementitious plaster coating 24 is then applied on the lath or mesh 23, completely immersing the lath and filling any spaces in the lath and between the lath and weather barrier 22. A suitable cementitious plaster 24 includes but is not limited to a mid-West formula (1 part Portland cement, 1 part mason cement, and 5 parts sand, mixed with an appropiate amount of water). After cementitious plaster coating 24 has set up partially but is not allowed to set or dry completely, a second coating 25 is preferably applied over the face of first coating 24. Second cementitious plaster coating 25 will typically be thinner than first coating 24, and both coats 24 and 25 will be typically be the same white color, although it will be understood that the color of the coatings may be different and is not critical to the invention. The total combined thickness of first plaster coating 24 and second plaster coating 25 in a preferred arrangement is between ⅝th inches and ¾ inches, although it will be understood that other thicknesses and additional cement plaster coatings may be provided depending upon the particular application while still falling within the intended scope of the invention.

After second coating 25 has been allowed to partially set, guide marks are placed on the outer surface of the plaster coating in a manner known to those skilled in the art, typically using a divider tool. Then using other known tools, typically a bubble stick and a hand-held cutting tool having a U-shaped blade, grooves 26 are cut into the plaster coating in order to sculpture the wall covering to have a desired simulative pattern or appearance. As is best shown in FIGS. 4 and 5, grooves 26 extend completely through outer or second coating or layer 25. In addition, grooves 26 extend into first coating or layer 24 to a depth down to or at substantially down to the lath 23. Depending upon its construction the lath 23 may be formed of individual wires woven together forming a diamond pattern as in a chain link fence, or may have a different construction, for example, the outwardly facing surface of lath 23 may not be flat and therefore grooves 26 if cut to a constant depth may be cut closer to lath 23 in some places than others. For purposes of describing the present invention in stating that the grooves are cut "substantially to" or "at least substantially to" the lath, or into "close proximity" to the lath or other reinforcing medium, it is meant to a depth that is great enough so that individualized units are formed each of which is separately secured to the lath. A shallow layer of cementitious material may still be covering the lath in some places; however, the depth of any such remaining layer is not great enough to prevent individualized drying of the units so that any shrinkage of one unit does not influence adjacent units. The U-shaped blade used to form the grooves may come into contact with the lath as such tool is being moved across the simulative wall covering to remove the cementitious material from the grooves.

As best shown in FIG. 3, the pattern formed by grooves 26 may be spaced apart or arranged as desired to provide a plurality of simulated sculptured units resembling bricks, blocks, tiles, stones, or other decorative structures or combinations thereof to be simulated on the face of the wall covering or panel. In FIG. 3, there are illustrated for exemplary purposes provision of square tiles 27, bricks 28, and larger rectangular stones or tiles 29. Between adjacent simulated bricks 28 grooves 26 are shown as being within the range of the usual width of mortar grooves between bricks. However, it will be evident that such grooves 26 may be slightly wider when simulated tiles 27 or stones 28 are to be formed, depending upon the circumstances. Because the grooves are cut substantially to the depth of the lath 23 immersed in coating 24, individual or individualized units are in effect formed, each of which is essentially separately supported on the lath 23. As the coatings are allowed to dry, the individual units resembling tiles 27, bricks 28, or stones 29 and formed by the grooves 26 dry separately, which retards stress and the formation of hairline cracks in the material which may be visible or eventually spread to the surface.

Once the wall covering has substantially set, an acrylic coating 30 is applied over the faces of the individual units resembling tiles 27, bricks 28, stones 29, or other designs, the coating 30 having a preferred color for the simulation. For example, a tile design may receive a top coat of white acrylic paint while a simulated brick receives a red acrylic finish. If acrylic paint is accidentally smeared to a surface, it can be easily cleaned with a chemical cleaner. Where the wall covering of the present invention is applied to exterior surfaces, an exterior masonry acrylic coating is applied over the faces of the bricks, preferably using a short nap roller or other suitable tooling so that the coating is not applied in joints 26. If desired, second or third coats of acrylic coating 30 of a different color may be applied over the first coat to make the surface look old, achieve another color, or to add texture to the surface.

Acrylic latex surface coating 30 not only simulates the structure desired, but also is a water based composition which as it dries provides a water barrier which is preferably weatherproof or waterproof between the face of the wall covering of the present invention and the atmosphere, decreasing evaporation from the surface and reducing the evaporation to that which can be expelled from the sides of the individual simulated bricks, blocks or tile units and since these tend to be all approximately the same size stabilizing drying and setting to a uniform rate compatible with the sizes of the individual units, spalling and cracking are thus virtually eliminated.

Once the acrylic coating 30 has been applied, then as shown in FIGS. 3 and 5 a conventional mortar or grout 31 may be applied in joints 26. Since grooves 26 have been cut to a depth that extends completely through outer plaster coating 25 and into inner plaster coating 24 substantially to lath 23, as a result the simulative tiles 27, bricks 28 or other simulated blocks 29 have been individualized or separated into individual units. There is therefore no hurry to finish the overall job because minimal cracking or spalling occurring in the individual units does not tend to spread between individual units. With the acrylic finish having already been applied, the surface of the plaster is protected, and the joint may now be mortared or grouted without staining occurring to the outer surface of the simulative wall covering. Cleanup of the acrylic finish may be performed with a suitable chemical cleaner, so that the surface will not become pitted or discolored. Any touch ups or recoloring of the acrylic coating 30 can be made between blocks with the acrylic latex paint. Furthermore, the tile, brick or block surfaces can be chemically cleaned without staining the surface as would occur without the acrylic coating.

As indicated above, the lack of cracking of the completed wall is due to the cutting of deep grooves in the cementitious layers to allow uniform evaporation of moisture from the ends of the brick sections plus the placement of lime or mortar between the bricks which is only lightly consolidated and also allows evaporation of moisture from the sides of the bricks. Once applied, the mortar further strengthens the wall and compensates for any strength lost due to cutting of grooves substantially to the depth of the lath. In other known applications having a scratch coat, grooves are not cut into the scratch coat but rather only into the two or more additional layers of cementitious material applied on top of the scratch coat. The mortar, however, does not form the same hard consolidated material so it does not tend to transfer cracks from one individualized unit or section to another. The mortar or grout applied in grooves 26 may also be provided in a contrasting color to the acrylic coating. Different types of finishing joints such as a grapevine joint or weep joint may also be simulated in the present invention. A single layer of cementitious material may be provided in some applications, although in a typical exterior wall at least two layers are provided so that the wall has the required thickness.

It is further noted that if a brick or tile design is defective, the unit can be smoothed over or removed while the cementitious coating is still soft and reformed with an acceptable design. The process described provides a very substantially cost savings as compared to a conventional brick wall structure, in part because is not needed to provide a footing support the coating product such as is required to support a brick wall. The waterproof acrylic coating applied to the surface may be a brick color or a stain, and provides a further benefit in protecting the simulated wall surface from the detrimental effects of acid rain and in general repels the elements so that the wall has a longer life span. The surface coloring will also be more uniform as compared to the prior Brickote™ process where the finish can streak or have efflorescence because it is a natural material with variations of color and moisture, while the new finish is synthetic and is applied on a dried, cured substrate. A silicone coating material may also be used in some applications. In addition, color matching is much easier in the present process, as ninety-five percent of brick colors can be matched by computer analysis and the finish of tile with the use of a high gloss acrylic finish, while matching color of a natural cement material is difficult due to the nature of the natural material and accounting for variations in shades and textures. It is impossible to replicate a glass-like finish of tile with the coarse texture of even the finest silica sand. Unlike the old Brickote™ process where a wall had to be manicured and patched as it is being finished because repairs must be done while the cement is soft, or otherwise repairs, patches and color variations will be obvious, in the presently described process, all repairs are masked, and no deviation of color or texture will show because when repairs are performed acrylic surfacing is applied over existing repairs on a dry cured surface as the final coat. The present process therefore saves many man hours and produces a more durable product and a more attractive facade, as well as travel time and expense because of return for making repairs and less days to produce an equal if not better result.

While the present invention has been described at some length and with some particularity with respect to the several described embodiments, it is not intended that it should be limited to any such particulars or embodiments or any particular embodiments, but it is to be construed with reference to the appended claims so as to provide the broadest possible interpretation of such claims in view of the prior art and, therefore, to effectively encompass the intended scope of the invention.

I claim:

1. A method of forming a wall covering of simulated units taken from the group of brick, stone, block and tile over an existing wall surface having applied a waterproof barrier followed by a lath support base in parallel with said waterproof barrier, comprising the steps of:

a. applying at least one cementitious layer over at least a section of the lath support base, completely immersing the lath support base in the at least one cementitious layer, said layer having an outer surface;

b. after the at least one cementitious layer has partially set up, forming grooves in the outer surface of the at least one cementitious layer, the arrangement of the grooves defining a plurality of simulated wall covering units and separating said simulated wall covering units from adjacent units at all points above the depth of the lath support base, c. applying to the outer surface of the at least one cementitious layer at least one water compatible covering material incorporating a color to simulate the particular wall unit; and d. after the water compatible covering material has dried, applying a mortar in said grooves.

2. A method in accordance with claim 1 wherein the outer covering material is an acrylic paint composition.

3. A method in accordance with claim 2 in which during the step of applying the at least one cementitious layer two consecutive layers are applied, the first layer covering and immersing the lath support base, and the second layer being applied over the outer surface of the first layer after the first layer has partially set UP, and during the step of forming grooves said grooves being cut completely through the second layer and into the first layer to the depth of the lath support base.

4. A method in accordance with claim 3 in which prior to step (d) at least one additional acrylic covering is provided over the outer surface of the units to provide a contrasting color and/or to add texture to the surface.

5. A simulative wall covering suitable for external use on buildings comprising:

a. a lath fastened to a building wall;

b. at least one layer of cementitious material applied on the lath so as to completely immerse the lath and filling the spaces in the lath and between the lath and building wall with cementitious material;

c. portions of the cementitious material being removed and forming grooves in said cementitious material extending inwardly to the depth of the lath;

d. said grooves defining a plurality of smaller masses of cementitious material which as a result of forming said grooves are secured to the lath completely independent of adjacent masses and outlining a replicative single wall construction taken from the group comprising bricks, stones, tiles and blocks;

e. a layer of moisture compatible protection material covering the outer surface of the cementitious material, and f. a grout or mortar which is provided in said grooves after the moisture compatible protection material has dried forming a mortar joint.

6. A simulative wall covering in accordance with claim 5 additionally comprising at least two layers of cementitious material abutting each other, in which a second layer is applied on a first layer applied on the lath after the first layer has partially set.

7. A simulative wall covering in accordance with claim 6 in which the layer of moisture compatible protection material includes a coloring agent.

8. A simulative wall covering in accordance with claim 7 in which the moisture compatible protection material is a waterproof masonry acrylic coating.

9. A simulative wall covering in accordance with claim 8 in which two or more layers of a moisture compatible protection material are provided having different coloring or texture properties.

10. A simulative wall covering in accordance with claim 9 in which a weather barrier is secured to the building wall underneath the lath and cementitious material applied on the lath completely immerses the lath and fills the spaces in the lath and between the lath and weather barrier.

11. A simulative wall covering in accordance with claim 10 in which the total thickness of the cementitious material is between ⅝ inches and ¾ inches.

12. A simulative wall covering in accordance with claim 11 in which the lath is a galvanized wire lath.

13. A simulative wall covering in accordance with claim 8 in which the grooves are spaced so that cracking and spalling of the individual units during drying of the cementitious material is minimized and formation of future hairline cracks is retarded.

* * * * *